US010900632B2

(12) United States Patent
Fritz et al.

(10) Patent No.: US 10,900,632 B2
(45) Date of Patent: Jan. 26, 2021

(54) CONFIGURABLE LIGHTING SYSTEM WITH SHARED LENS AND FIRST AND SECOND INTERNAL OPTICS FORMING A FIRST AND SECOND MODULE CONFIGURATION FOR PROVIDING TWO DIFFERENT LIGHTING FUNCTIONS

(71) Applicant: VALEO NORTH AMERICA, INC., Troy, MI (US)

(72) Inventors: Chadwick Fritz, Seymour, IN (US); Don Hodnett, Seymour, IN (US); Greg Simons, Columbus, IN (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 16/810,432

(22) Filed: Mar. 5, 2020

(65) Prior Publication Data

US 2020/0200352 A1 Jun. 25, 2020

Related U.S. Application Data

(63) Continuation of application No. 16/022,197, filed on Jun. 28, 2018, now Pat. No. 10,619,814.

(51) Int. Cl.

| | |
|---|---|
| ***F21S 2/00*** | (2016.01) |
| ***F21S 41/20*** | (2018.01) |
| ***F21S 41/36*** | (2018.01) |
| ***F21S 41/29*** | (2018.01) |
| ***F21S 41/39*** | (2018.01) |

(52) U.S. Cl.

CPC ..... *F21S 41/285* (2018.01); *F21S 41/29* (2018.01); *F21S 41/36* (2018.01); *F21S 41/39* (2018.01)

(58) Field of Classification Search

CPC ..... F21S 41/39; F21S 41/36; F21S 41/19

See application file for complete search history.

(56) References Cited

U.S. PATENT DOCUMENTS

| | | | |
|---|---|---|---|
| 3,431,449 | A | 3/1969 | Hundley |
| 6,331,068 | B1 | 12/2001 | Chase |
| 7,722,233 | B2 | 5/2010 | Meyrenaud |
| 8,070,338 | B2 | 12/2011 | Boroczki et al. |

(Continued)

FOREIGN PATENT DOCUMENTS

| | | | |
|---|---|---|---|
| EP | 2 586 594 | B1 | 8/2017 |

*Primary Examiner* — Robert J May

(74) *Attorney, Agent, or Firm* — Valeo North America, Inc.

(57) ABSTRACT

A configurable vehicle lighting module system includes a shared lens configured to provide a first light pattern for a first vehicle lighting function and a second light pattern for a second vehicle lighting function. The shared lens includes a mounting axis which provides a reference for mounting the shared lens on a vehicle. First internal optics are configured to direct light toward the shared lens to provide the first light pattern, and second internal optics are configured to direct light toward the shared lens to provide the second light pattern. A coupling system is configured to join the shared lens with either the first internal optics to form a first module configuration for providing the first vehicle lighting function, or with the second internal optics to form a second module configuration for providing the second vehicle lighting function. The shared lens conceals physical differences between the first and second internal optics such that the first and second light module configurations have the same appearance when viewed along the mounting axis of the shared lens.

20 Claims, 7 Drawing Sheets

(56) References Cited

U.S. PATENT DOCUMENTS

| | | | |
|---|---|---|---|
| 9,829,167 | B2 | 11/2017 | Berthold |
| 10,180,223 | B2 | 1/2019 | Grammer |
| 2014/0016343 | A1 | 1/2014 | Brendle |
| 2014/0226355 | A1 | 8/2014 | Blandin et al. |
| 2017/0276309 | A1 | 9/2017 | Nakazawa |
| 2017/0292671 | A1 | 10/2017 | Gousset-Rousseau |
| 2018/0135827 | A1 | 5/2018 | Lee |

CONFIGURABLE LIGHTING SYSTEM WITH SHARED LENS AND FIRST AND SECOND INTERNAL OPTICS FORMING A FIRST AND SECOND MODULE CONFIGURATION FOR PROVIDING TWO DIFFERENT LIGHTING FUNCTIONS

CROSS-REFERENCE TO RELATED APPLICATIONS

This application is a continuation of U.S. application Ser. No. 16/022,197 filed Jun. 28, 2018, the entire contents of which is incorporated herein by reference.

BACKGROUND

Field of the Disclosure

This disclosure relates generally to vehicle lighting, and more particularly to a vehicle lighting module that can be configured to provide different vehicle lighting functions while maintaining the same appearance on a vehicle.

Description of the Related Art

Modern vehicles include lighting systems that provide various vehicle lighting functions. For example, a vehicle head lamp function is generally required to project light in front of a vehicle to provide visibility for driving at night. Typically, a vehicle head lamp has a high beam function to enhance visibility at relatively far distances in front of the vehicle, as well as a low beam function to enhance visibility at relatively short distances without dazzling oncoming or leading drivers. Many other vehicle lighting functions such as a supplemental high beam function, a supplemental low beam function, a static bending light function, a cornering function, etc. may be desired to assist in different driving conditions.

To achieve economies of scale, automobile manufacturers often sell the same vehicle model in different markets throughout the world. However, a desired lighting function in one regional market may be different from a desired lighting function in another regional market. For example, the North American market for vehicle lighting may require a supplemental lighting function to enhance the low or high beam function of a head lamp, while the European marketplace may require a static bending or cornering light function to illuminate the turning path of the vehicle. Thus, vehicle manufacturers may request that lighting suppliers provide a standard lighting device to fit the dimensions and styling of a specific vehicle model, yet provide alternative vehicle lighting functions to satisfy the demand of different vehicle markets.

Conventionally, each vehicle lighting function is provided by a uniquely designed lighting module dedicated to performing the single lighting function for which the lighting module is designed. The present inventors have recognized that this practice causes non-uniform appearance of vehicle lighting devices on the same vehicle model across markets. Further, the need for completely different lighting modules in different regions adds complexity and cost to the design and manufacture of lighting devices intended for the same vehicle model.

SUMMARY

Accordingly, one object of the present disclosure is to overcome the above noted problems with conventional vehicle lighting. Another object is to provide a lighting apparatus which overcomes the above-mentioned limitations of complexity, cost, and non-uniform appearances across different markets. These and/or other objects of the present disclosure may be provided by the following example aspects of this disclosure.

Aspect (1) is a configurable vehicle lighting module system which includes a shared lens configured to provide a first light pattern for a first vehicle lighting function and a second light pattern for a second vehicle lighting function. The shared lens includes a mounting axis which provides a reference for mounting the shared lens on a vehicle. First internal optics are configured to direct light toward the shared lens to provide the first light pattern for the first vehicle lighting function, and second internal optics are configured to direct light toward the shared lens to provide the second light pattern for the second vehicle lighting function. A coupling system is configured to join the shared lens with either the first internal optics to form a first module configuration for providing the first vehicle lighting function, or with the second internal optics to form a second module configuration for providing the second vehicle lighting function. The shared lens conceals physical differences between the first and second internal optics such that the first and second light module configurations have the same appearance when viewed along the mounting axis of the shared lens.

Aspect (2) includes the system of aspect (1), wherein the first light pattern includes a first direction, a first horizontal spread and a first vertical spread, and the second light pattern includes a second direction, a second horizontal spread and a second vertical spread. At least one of the first direction, first horizontal spread and first vertical spread of the first light pattern is different from a respective one of the second direction, second horizontal spread and second vertical spread of the second light pattern.

Aspect (3) includes the system of aspect (2), wherein the shared lens includes a first region configured to provide the first light pattern, and a second region configured to provide the second light pattern.

Aspect (4) includes the system of aspect (3), wherein the first region partially overlaps with the second region.

Aspect (5) includes the system of aspect (2), wherein a first direction of the first light pattern is offset from a second direction of the second light pattern by an offset angle along a horizon direction substantially perpendicular to the reference axis.

Aspect 6 includes the system of aspect (3), wherein the shared lens is a blended lens.

Aspect (7) includes the system of Aspect (2), wherein the first internal optics includes a first reflector configured to direct light for the first light pattern toward the shared lens, and the second internal optics includes a second reflector configured to direct light for the second light pattern toward the shared lens.

Aspect (8) includes the system of aspect (1), wherein each of the first and second internal optics includes an optical portion including at least one optical element, and a holding portion configured to be attached to the optical portion such that the shared lens is joined with the optical portion to form an integral vehicle lighting module.

Aspect (9) includes the system of aspect 1, wherein the coupling system includes a first joining portion provided on the shared lens, and a second joining portion provided on each of the first and second internal optics, the first joining portion configured to engage the second joining portion such that the shared lens can be joined with either one of the first and second internal optics.

Aspect (10) includes the system of Aspect 9, wherein the first joining portion includes a plurality of tabs provided on the shared lens, and the second joining portion includes a plurality of corresponding recesses provided on each of the first and second internal optics and configured to engage the respective plurality of tabs.

Aspect (11) includes the system of Aspect 1, further including a first light source configured to provide light for the first light pattern and a second light source configured to provide light for the second light pattern.

Aspect (12) includes the system of aspect (11), wherein the first light source is positioned in a first position relative to the reference axis, and the second light source is positioned in a second position offset from the first position by an X offset distance in an X direction parallel to the reference axis and a Y offset distance in a Y direction perpendicular to the X direction.

Aspect (13) includes the system of aspect (12), wherein the X offset amount is approximately 2 mm and the Y offset amount is approximately 6.38 mm.

Aspect (14) includes the system of aspect (13), wherein the first lighting function is a supplemental lighting function for enhancing a high beam light function, and the second lighting function is a static bending lighting function for illuminating a turning path of the vehicle.

Aspect (15) includes the system of aspect (14), wherein the supplemental lighting function provides a light beam substantially along the reference axis of the shared lens; and the static bending lighting function provides a light beam along a direction which is offset from the reference axis by a predetermined angle.

Aspect (16) includes the system according to aspect (15), wherein the predetermined offset angle is greater than 0° and less than 90°.

Aspect (17) includes the system according to aspect (16), wherein the predetermined offset angle is approximately 30°.

Aspect (18) includes the system of aspect (1), further including a first bracket configured to fix the first lighting module to a vehicle model, and a second bracket configured to fix the second lighting module to the vehicle model.

Aspect (19) includes the system of aspect (18), wherein the first and second bracket include a shared bracket identically designed for the first and second module configurations.

Aspect (20) includes the system of Aspect (19), wherein the shared bracket includes a mounting surface for a light source.

The forgoing general description of the illustrative implementations and the following detailed description thereof are merely exemplary aspects of the teachings of this disclosure, and are not restrictive.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and may or may not represent actual or preferred values or dimensions. Where applicable, some or all features may not be illustrated to assist in the description of underlying features. In the drawings.

DETAILED DESCRIPTION

Figure 1A:
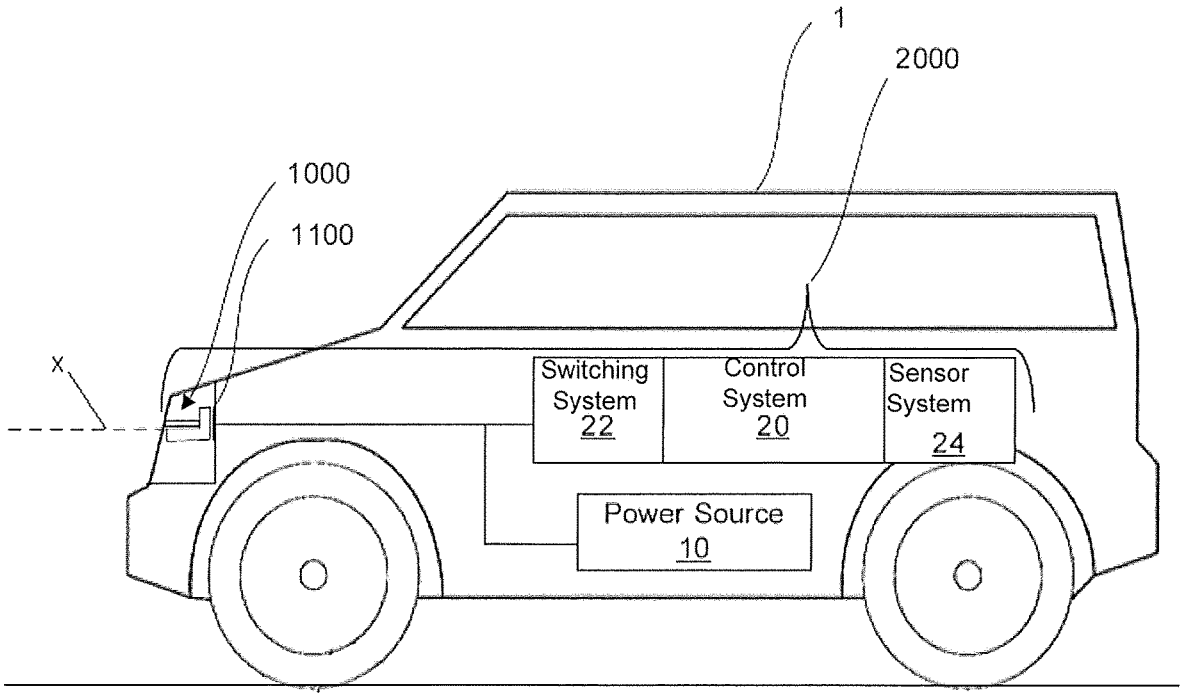
FIG. 1A is a schematic illustration of a lighting system of a vehicle, according to an exemplary embodiment of the present disclosure.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed embodiment(s). However, it will be apparent to those skilled in the art that the disclosed embodiment(s) may be practiced without those specific details. In some instances, well-known structures and components may be shown in block diagram form in order to avoid obscuring the concepts of the disclosed subject matter.

It is to be understood that terms such as "front," "rear," and the like that may be used herein merely describe points of reference and do not necessarily limit embodiments of the present disclosure to any particular orientation or configuration. Furthermore, terms such as "first," "second," "third," etc., merely identify one of a number of portions, components, and/or points of reference as disclosed herein, and likewise do not necessarily limit embodiments of the present disclosure to any particular configuration or orientation.

Furthermore, the terms "approximately," "proximate," "minor," and similar terms generally refer to ranges that include the identified value within a margin of 20%, 10% or preferably 5% in certain embodiments, and any values therebetween. FIG. 1 is a side view of a lighting system 2000 of a vehicle 100, according to certain aspects of the disclosure.

As discussed in the Background above, conventional vehicle lighting modules present a different appearance based on the lighting function for which the module is designed. Specifically, as each vehicle lighting function has a different lighting pattern, optical systems for creating the lighting patterns must be different. For example, the outer lens of a lighting module for one vehicle lighting function may be sized, shaped, and/or oriented differently than the outer lens of a lighting module for providing a different vehicle lighting function. Further, non-optical components such as bezels and attachment brackets of the lighting module must be different to accommodate the different lens configurations. These differences in optical and non-optical components give the lighting modules a different appearance when assembled on a vehicle, and require expensive manufacturing tooling to accommodate each module despite the fact that the modules are intended for the same vehicle model.

According to embodiments disclosed herein, a configurable lighting module permits alternative lighting module configurations that provide alternative vehicle lighting functions while maintaining a uniform look for each configuration of the module when assembled in the vehicle. In one embodiment, the configurable lighting module system includes a shared lens that can be coupled to different internal optics that are configured to provide different vehicle lighting functions. While each of the alternative internal optics has a different physical appearance, the shared lens is generally opaque and conceals these differences when the module is assembled such that the alternative module configurations can have a uniform appearance.

Further, the configurable lighting module includes a coupling system to join the shared lens with either of the alternative internal optical systems such that the alternative module configurations have the same outer appearance. For example, the coupling system may be at least partially incorporated into a bezel which surrounds the shared lens and provides the same appearance for each configuration of the lighting module. Electrical elements such as printed circuit boards, light sources, connectors etc., as well mechanical elements such as brackets, mounting pads etc. may also be provided as part of the lighting module configurations. Different appearance of such elements may also be concealed behind visible elements of the module configurations such as the shared lens or bezel. Configurability of the lighting module also permits configurability of higher level lighting devices such as a head lamp lighting apparatus.

FIG. 1A is a schematic illustration of a vehicle in which embodiments of the present disclosure can be implemented. As seen, the vehicle 1 has a longitudinal axis X extending along the general direction of travel of the vehicle. The vehicle includes a lighting system 2000 having various lighting devices 1000. Electrical components of the lighting system 2000 control the lighting devices 1000 as will be discussed below.

Figure 1B:
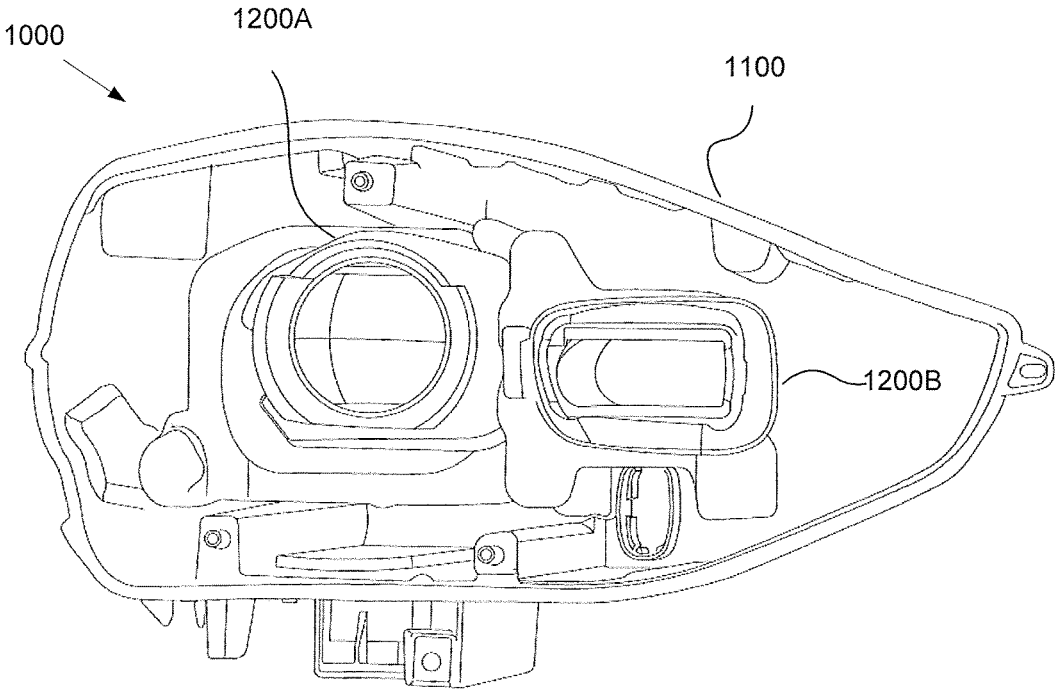
FIG. 1B is a schematic view of an example lighting apparatus according to an exemplary embodiment of the present disclosure.

FIG. 1B is a schematic illustration of an example lighting apparatus according to embodiments of the present disclosure. As seen, the apparatus 1000 includes a housing 1100 for containing various components of the lighting apparatus 1000. Such components may include mechanical components such as mounting brackets, aesthetic components such as bezels, optical components such as reflectors or lenses, and electrical components such as light sources and power circuits, for example. The housing 1100 of FIG. 1B includes two lighting modules 1200A and 1200B for providing vehicle lighting functions from the lighting apparatus 1000. For example, the apparatus may serve as a head lamp unit in which module 1200A provides a high/low beam function and the lighting module 1200B provides a different or supplementary lighting function for the head lamp. The housing 1100 is configured to connect to the higher level assembly of a specific vehicle model, regardless of the particular lighting modules provided within the housing. Lighting apparatus 1000 may include a clear outer cover lens (not shown) which encloses the lighting modules 1200A, 1200B and other components within the housing 1100.

Figure 2:
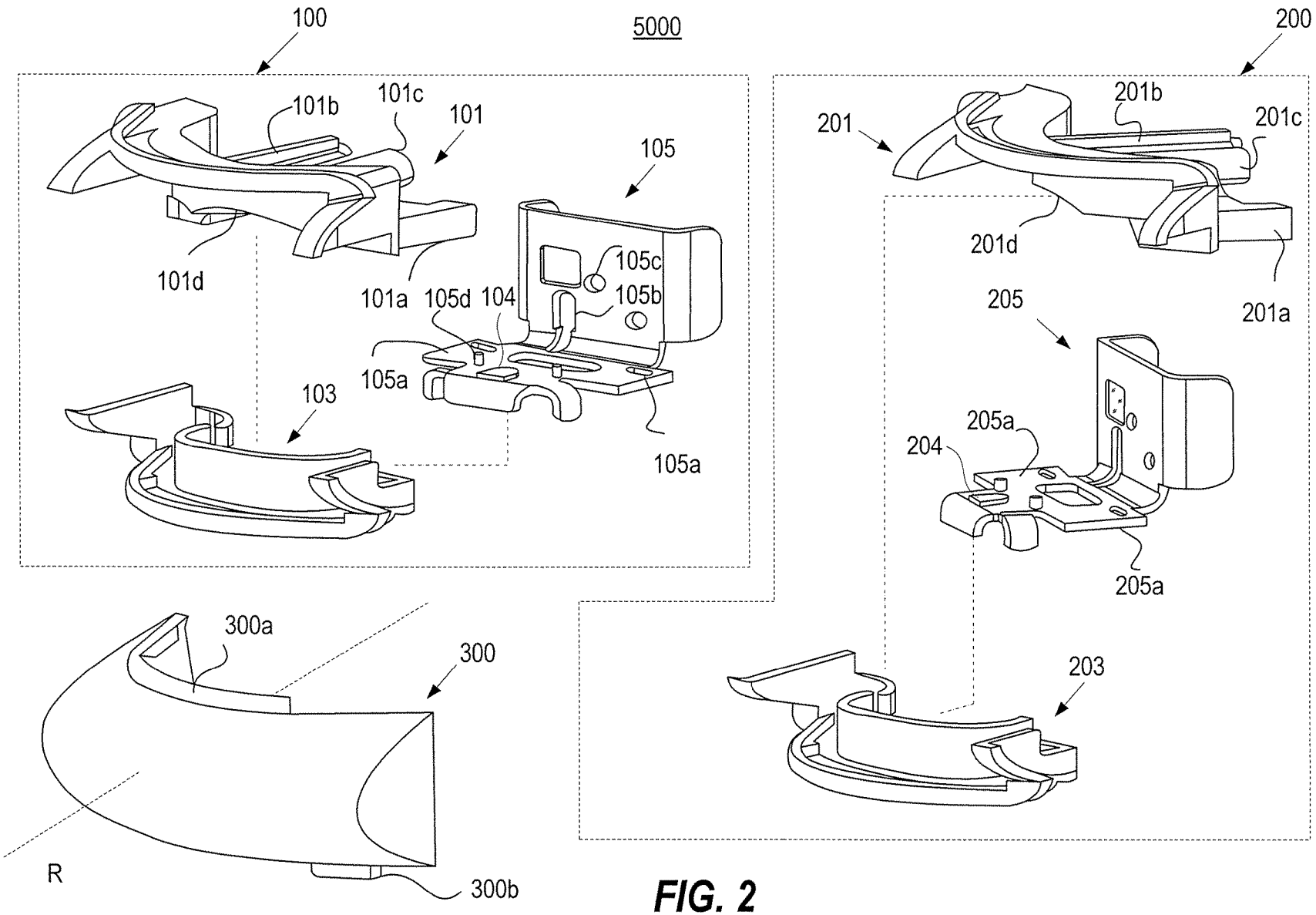
FIG. 2 illustrates exploded views of a lighting module assembly according to an exemplary embodiment of the present disclosure.

According to embodiments disclosed herein, module 1200B may be formed from a configurable lighting module system which permits alternative module configurations providing alternative lighting functions while maintaining a consistent look for each configuration of the module 1200B. FIG. 2 illustrates exploded views of a configurable lighting module system 5000 according to an exemplary embodiment of the present disclosure.

The configurable lighting module system 5000 includes first configuration parts 100 to form a first lighting module configuration, second configuration parts 200 to form a second module configuration, and shared lens 300 for use in each of the first and second module configurations. The first and second configuration parts 100, 200 include components that are not necessary for forming the first and second module configurations as will become clear from the discussion below. The first module configuration provides a first light pattern for a first vehicle lighting function, and the second module configuration provides a second light pattern for a second vehicle lighting function. Each of the first and second light patterns has a characteristic direction, horizontal spread and vertical spread, and at least one of these characteristics of the light pattern is different between the first and second light patterns. Thus, the shared lens 300 is optically configured to provide both the first and second light patterns from a singular structure. As seen in the example of FIG. 2, the shared lens 300 includes a reference axis R which provides a mounting reference for mounting the shared lens 300, and associated parts, on a vehicle.

A first module configuration includes first internal optics configured to direct light toward the shared lens 300 to provide the first light pattern for the first vehicle lighting function. Second internal optics configured to direct light toward the shared lens to provide the second light pattern for the second vehicle lighting function. In the embodiment of FIG. 2, the first internal optics includes a first reflector 101 and the second internal optics includes a second reflector 201. A coupling system is configured to join the shared lens with either the first internal optics to form a first module configuration for providing the first vehicle lighting function, or with the second internal optics to form a second module configuration for providing the second vehicle lighting function. In the embodiment of FIG. 2, the coupling system includes tabs on the shared lens 300 and recesses on the reflectors 101, 201 as will be discussed below. The shared lens 300 conceals physical differences between the first and second internal optics such that the first and second light module configurations have the same appearance when viewed along the reference axis R of the shared lens 300.

The configurable lighting module system 5000 includes first and second light sources 104, 204, as well as mounting parts 105, 205 for attaching the module to a higher level assembly such as a headlamp housing. However, such light source and mounting parts may be provided separately from the shared lens and internal optics of the module. In one embodiment, the light source may be connectable to the mounting parts.

According to the present disclosure, the configurable vehicle lighting module can provide two or more configurations for respective light patterns corresponding to alternative vehicle lighting functions. The alternative lighting functions may be any light pattern for providing any vehicle signaling or illumination function. However, the embodiment of FIG. 2 and the remaining figures of this disclosure are described in reference to a configurable vehicle lighting module system for providing either a supplemental lighting function or a static bending lighting function. As one example, Insurance Institute for Highway Safety (IIHS) ratings may make a supplemental head lamp beam (either supplemental high beam or supplemental low beam) lighting function desirable for the North American market, while European directives, may make a static bending light function desirable for the European market. Embodiments of this disclosure enable a vehicle lighting device that is configurable to provide either of these lighting functions while having a uniform look when used on a common vehicle model.

The first configuration parts 100 include a first optical reflector 101, a first holder 103, and a first light source 104 which is shown attached to a first bracket 105. When assembled, the first light source 104 is placed between the first holder 103 and the first reflector 101. The first holder 103 and/or the first reflector 101 supports the first bracket 105 in such a way as to align the first reflector 101 with the first light source 104 on the first bracket 105. In the first module configuration, the light source 104 and reflective surface 101*d* are oriented to face one region of the lens 300 such that the first module configuration provides a supplemental light function of a head lamp.

The first reflector 101 includes channels 101*a*, alignment portion 101*b* and fastener receiving portion 101*c*. Channels 101*a* are provided on opposing sides of the reflector 101 and are configured to slidably receive opposing edges 105*a* of bracket 105 to aid in assembly of the bracket 105 and reflector 101. Further, alignment portion 101*b* of the reflector engages alignment slot 105*b* of the bracket when the edges 105*a* are fully inserted into the channels 101*a*. The fastener receiving portion 101*c* is aligned with fastener hole 105*c* of the bracket such that a fastener (e.g., an assembly screw—not shown), can fix the reflector 101 to the bracket 105. In this fixed position, the light source 104 is aligned opposite to the reflective surface 101*d* of the first reflector 101 such that light from the source 104 is directed toward the lens 300.

The reflective surface 101*d* is a parabolic reflecting surface configured to reflect light from the first light source 104 towards the lens 300 to provide the supplemental lighting function. Spacing pins 105*d* of the bracket provide a predetermined space between the light source 104 and reflective surface 101*d*. The reflective surface 101*d* may be replaced or supplemented by other optical components forming the internal optics for optically coupling light from the light source to the shared lens 300 for providing the supplemental lighting function.

Shared lens 300 is coupled to the first reflector 101 by way of holder 103. As seen, upper tabs 300*a* are provided on the lens 300 to engage recesses in the reflector 101, and lower tabs 300*b* of the lens 300 are provided to engage recesses in the holder 103. With the tabs 300*a* and 300*b* engaged with respective recesses, the holder 103 is fixed to the reflector 101 such as by snap friction fitting to create the first module configuration 100 as an integral unit. As seen in FIG. 2, the shared lens 300 includes a reference axis R which provides a reference from which to measure alignment of the first and second module configurations when mounting the module within a lighting apparatus 1000 and/or to the vehicle 1.

The second configuration parts 200 include a second reflector 201, a second holder 203, and a second light source 204 attached to a second bracket 205. When assembled, the second light source 204 is placed between the second holder 203 and the second reflector 201. The second holder 203, second bracket 205 and second reflector 201 are assembled as an integral unit in the same way as the first module configuration. In the second module configuration parts 200, the light source 204 and reflective surface 201*d* are oriented to face a second end (right in FIG. 2) of the shared lens 300 so as to provide the static bending light function of a head lamp.

In the embodiment of FIG. 2, the reflectors 101, 201 provide internal optics for optically coupling light from a light source 104, 105 to the shared lens 300, while holders 103, 203 provide a structural base and coupling elements for joining the shared lens 300 to either of the internal optical systems. Alternatively, the reflector and holder may be an integral unit providing the internal optics to which shared the lens 300 (and brackets etc.) are assembled.

Figure 3A:
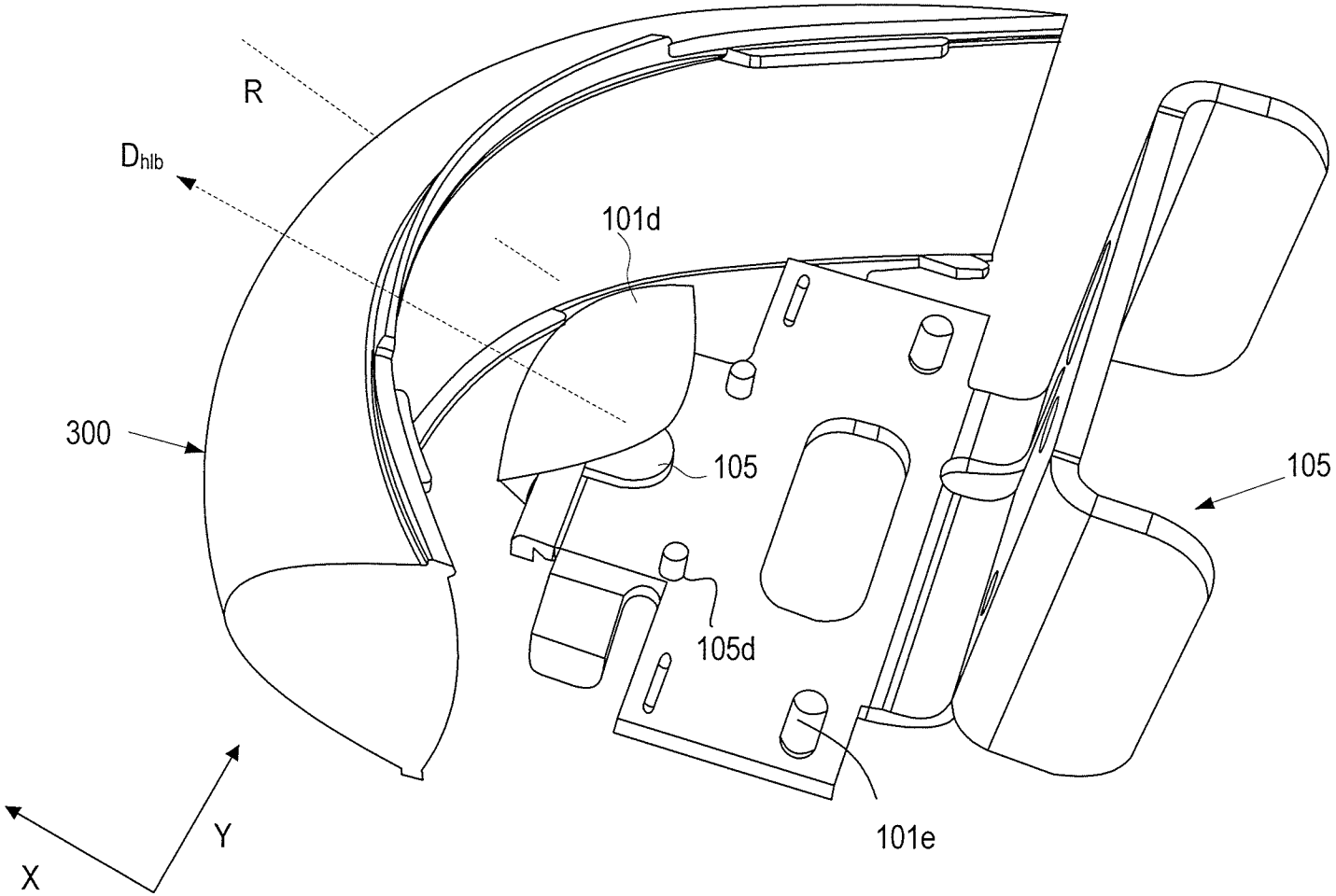
FIG. 3A illustrates a first configuration of the lighting module assembly oriented to provide supplemental light function according to an exemplary embodiment of the present disclosure.

FIG. 3A illustrates the lighting module system 5000 configured in a first module configuration according to an exemplary embodiment of the present disclosure. For clarity, the holder 103 is horizontally sectioned to show only the reflective surface 101*d* and alignment pins 105*e*. As seen, light from the first light source 105 is directed through the lens 300, via the first reflector 101, in a first direction $D_{hlb}$. The first direction may be a direction along the reference axis R of the shared lens 300 which is substantially parallel to the vehicle axis X of the vehicle 1, or angularly offset from the reference axis R.

Figure 5A:
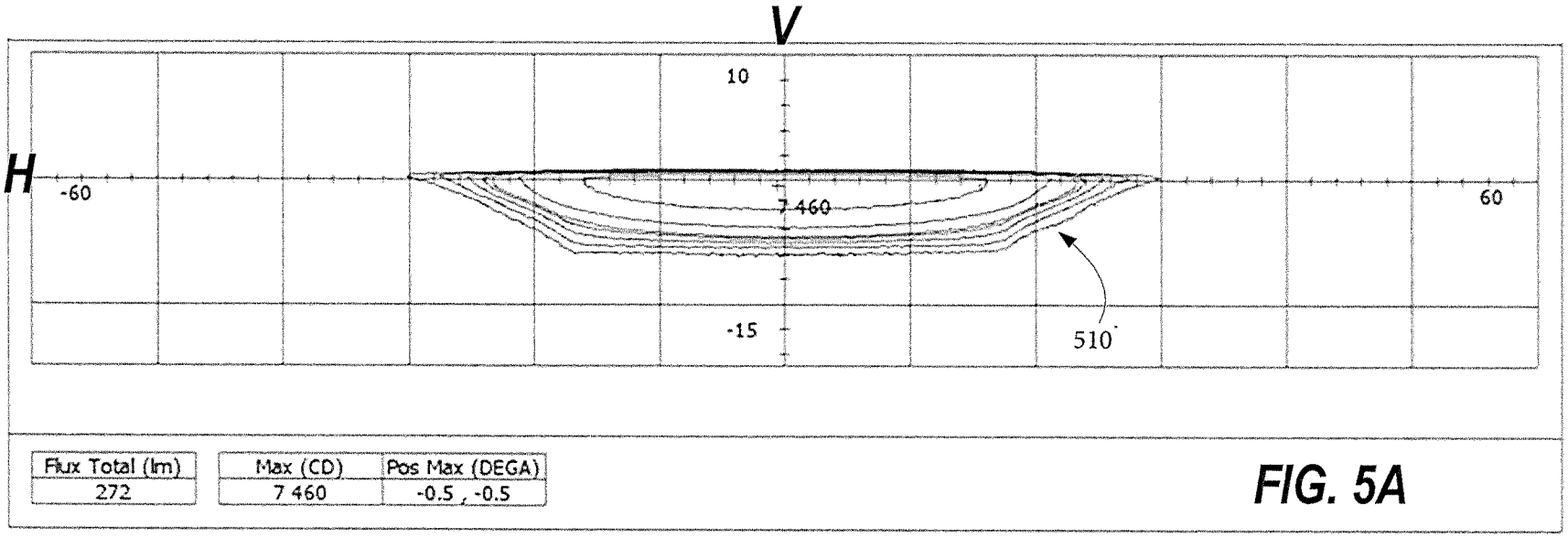
FIG. 5A is a first light pattern corresponding to the supplemental light function, according to an exemplary embodiment of the present disclosure.

FIG. 5A shows one light pattern corresponding to a supplemental high beam light function generated by the lighting apparatus 1000 when a first module configuration is employed, according to an exemplary embodiment of the present disclosure. The pattern is shown on a two dimensional plot with the H line corresponding to a horizon of the vehicle and the V line corresponding to a longitudinal axis of the vehicle. The reference axis R of the shared lens 300 may or may not correspond to the H-V intersection point, depending on the manufacturer of the lighting device and the orientation of the lens on the vehicle. In the embodiment of FIG. 5A, the supplemental light beam pattern 510 has a direction (i.e. optical axis) generally toward the H-V intersection point, and a horizontal spread of about 60° (i.e., approximately ±30° from the V axis). A vertical spread of the supplemental light beam pattern is truncated approximately at the H axis such that the pattern spans from approximately 0° to −8° below the H axis. The light intensity is relatively higher at the center C of the pattern and decreases gradually as the light spreads away from the center C of the pattern.

The supplemental light beam function (or other vehicle lighting functions) can be provided by a pattern spanning any angular range between −90° and +90° from reference axis R. The first light pattern can accommodate the first set of local market requirements, e.g. Insurance Institute for Highway Safety ratings. The supplemental light function allows a driver to view objects in front of the vehicle while driving, and/or to reduce dazzle to drivers of oncoming vehicles, for example.

Figure 3B:
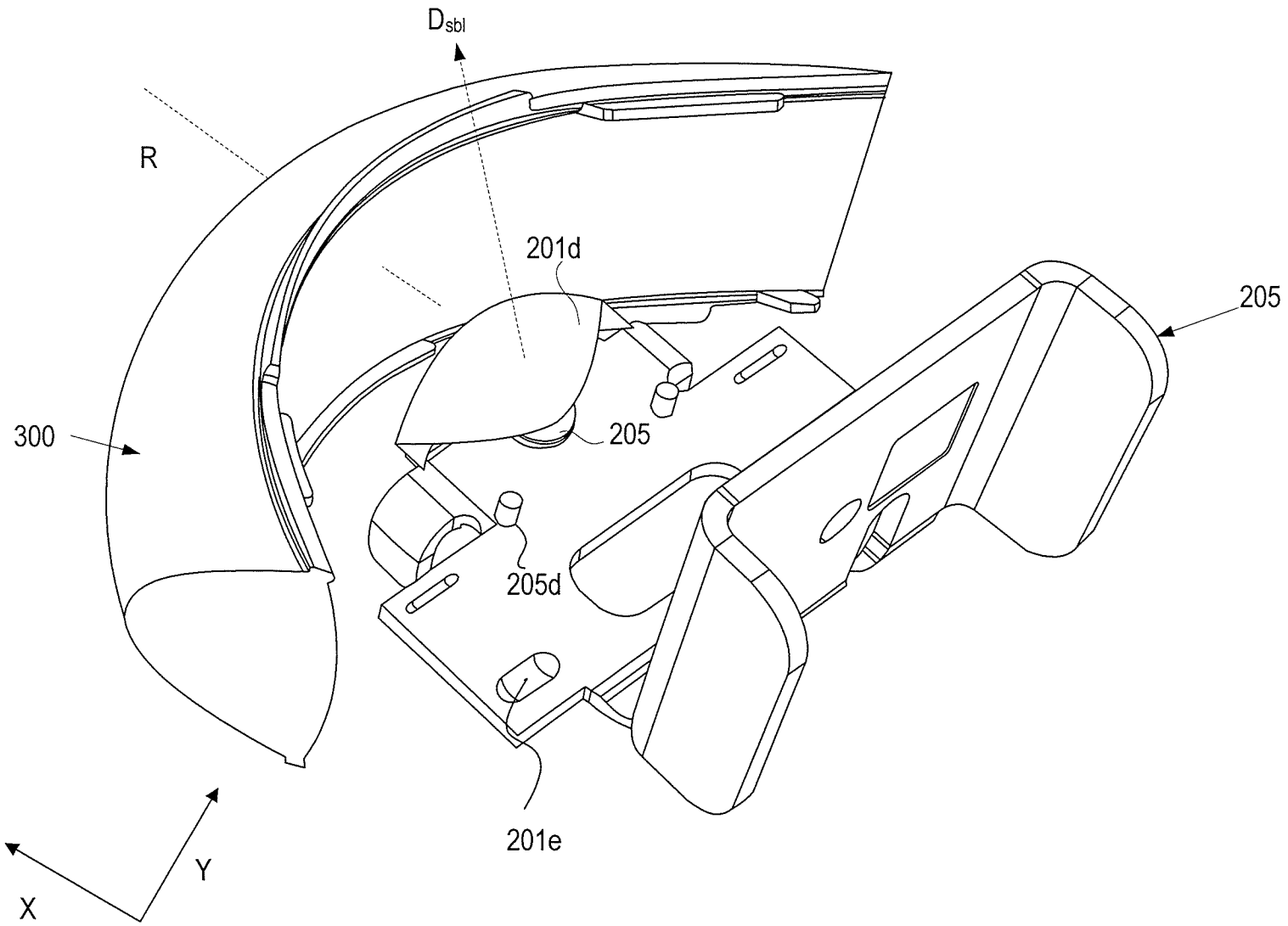
FIG. 3B illustrates a second configuration of the lighting module assembly oriented to provide static bending light function according to an exemplary embodiment of the present disclosure.

FIG. 3B illustrates the lighting module system 5000 configured in a second module configuration to provide the static bending light function according to an exemplary embodiment of the present disclosure. In order to provide the static bending light function, light from the second light source 205 is directed through the lens 300, via the second reflector 201, in a second direction $D_{sbl}$. The second direction is a direction oriented at an angle with respect to the first direction. In the static bending light function, the light is projected along the second direction to illuminate objects in a turning path of the vehicle (left or right) and/or objects beside the vehicle, for example, people at a curb on right side of a turning vehicle.

Figure 5B:
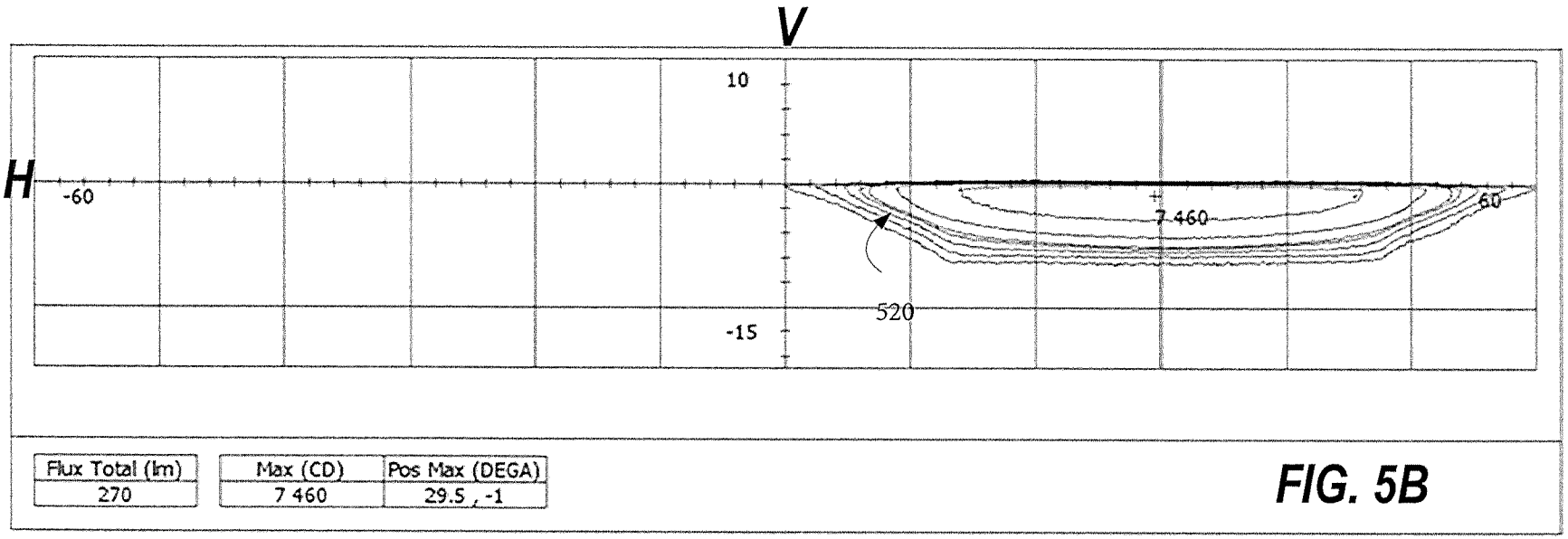
FIG. 5B is a second light pattern corresponding to the static bending light function light function, according to an exemplary embodiment of the present disclosure.

FIG. 5B shows one light pattern corresponding to a static bending light function generated by the lighting apparatus 1000 when a first module configuration is employed, according to an exemplary embodiment of the present disclosure. The pattern is shown on the same two dimensional plot as with the pattern of FIG. 5A, with the reference axis R of the shared lens 300 being the same orientation as in FIG. 5A. In the embodiment of FIG. 5B, the static bending light pattern 520 has a direction (i.e. optical axis) generally offset from the H-V intersection point by about 30° along the horizon axis H. The horizontal spread of pattern 520 is about 60°, and extends from approximately 0° to approximately +60° due to the offset direction of the pattern. A vertical spread of the static bending light beam pattern 520 is also truncated approximately at the H axis such that the pattern spans from approximately 0° to −8° below the H axis, and light intensity is relatively higher at the center of the pattern and decreases gradually as the light spreads away from the center of the pattern. This second light pattern can accommodate the static banding light functions to meet European market requirements.

However, the offset for the static bending light function (or other vehicle lighting function) may be any offset angle greater than 0° and less than 90° relative to the H-V intersection. Further, the offset angle may be negative or positive with respect to the H-V intersection direction depending on the outboard direction to be illuminated for example. The horizontal and vertical spread of the static bending light function may be set to market demands and/or legal requirements.

A comparison of FIGS. 3A and 5A reveals that the light source is positioned differently from the first configuration to the second configuration. The ability of the shared lens 300 to be used with either the first light module configuration 100 or the second light module configuration 200 is achieved by relative positioning of the light source and reflective surface (or other optical element) within a module configuration. The present inventors discovered that a lighting module cannot be configured to provide a supplemental light function and a static bending light function by merely rotating the reflective surface in a horizontal plane about the light source. Specifically, such a simple rotation of the light direction in a horizontal plane caused light to fail legal requirements for preventing dazzling of oncoming drivers and/or did not provide for adequate supplemental lighting or static bending light function.

The inventors discovered that these issues can be overcome by translating the light source and/or reflector in both an X and Y direction in the horizontal plane such that both a supplemental light beam function and a static bending light function can be adequately provided with a shared lens while also meeting legal requirements for all local markets. The precise amount of translation will depend on the desired lighting functions to be obtained from the shared lens. In the example of FIGS. 3A and 3B, the LED light source 104 was provided in a first reference position within the first configuration, while the LED light source 204 was offset from this reference position in an x direction by 2 mm and offset in a y direction by 7.68 mm. This repositioning of the LED provided the legally acceptable and functionally desirable light patterns of FIGS. 5A and 5B through a shared lens.

The ability of the lens 300 to be used with both the first module configuration 100 and the second module configuration 200 provides a substantially uniform appearance across vehicles that meet the first local market requirements and the second local market requirements. Once the lighting apparatus 1000 is mounted on the vehicle 1 no visual distinction, e.g. through the naked eye, between the lighting apparatus 1000 with the first module configuration and the lighting apparatus 1000 with the second module configuration can be detected. For example, the lens 300 can provide an external surface 310 substantially, smooth, continuous, uniform, e.g. without gaps, separations, joints, and/or changes of orientations, and/or without supplemental optical instruments, e.g. prisms, pillows, bezels, and/or supplemental lenses, as illustrated in FIG. 2.

In a preferred embodiment, the shared lens can be symmetrical about at least one of a vertical axis and a horizontal axis such that an identical lens design may be used within a right side or left side lighting apparatus of the vehicle. For example, a fully symmetrical lens design can be used in modules of both the driver side and passenger side head lamps without a particular orientation of the lens within the lighting module. As another example, the lens 300 may be optically asymmetrical about a vertical centerline of the lens to facilitate a supplemental beam function and static bending light function from the same lens. Such and asymmetric optical design may be mechanically symmetrical about the horizontal centerline of the lens so that the identical lens design can flipped approximately 180° (for example) for use in a module of the driver side head lamp and a module of the passenger side head lamp. This provides further reduction in cost and complexity of the reconfigurable module. In addition, the shared lens 300 allows switching between the supplemental light function and the static bending light function, and vice-versa, without requiring to change and/or altered parts, components and/or portions, e.g. module rotation, supplementary lenses, and/or bezels, of the light apparatus 1000.

Figure 4A:
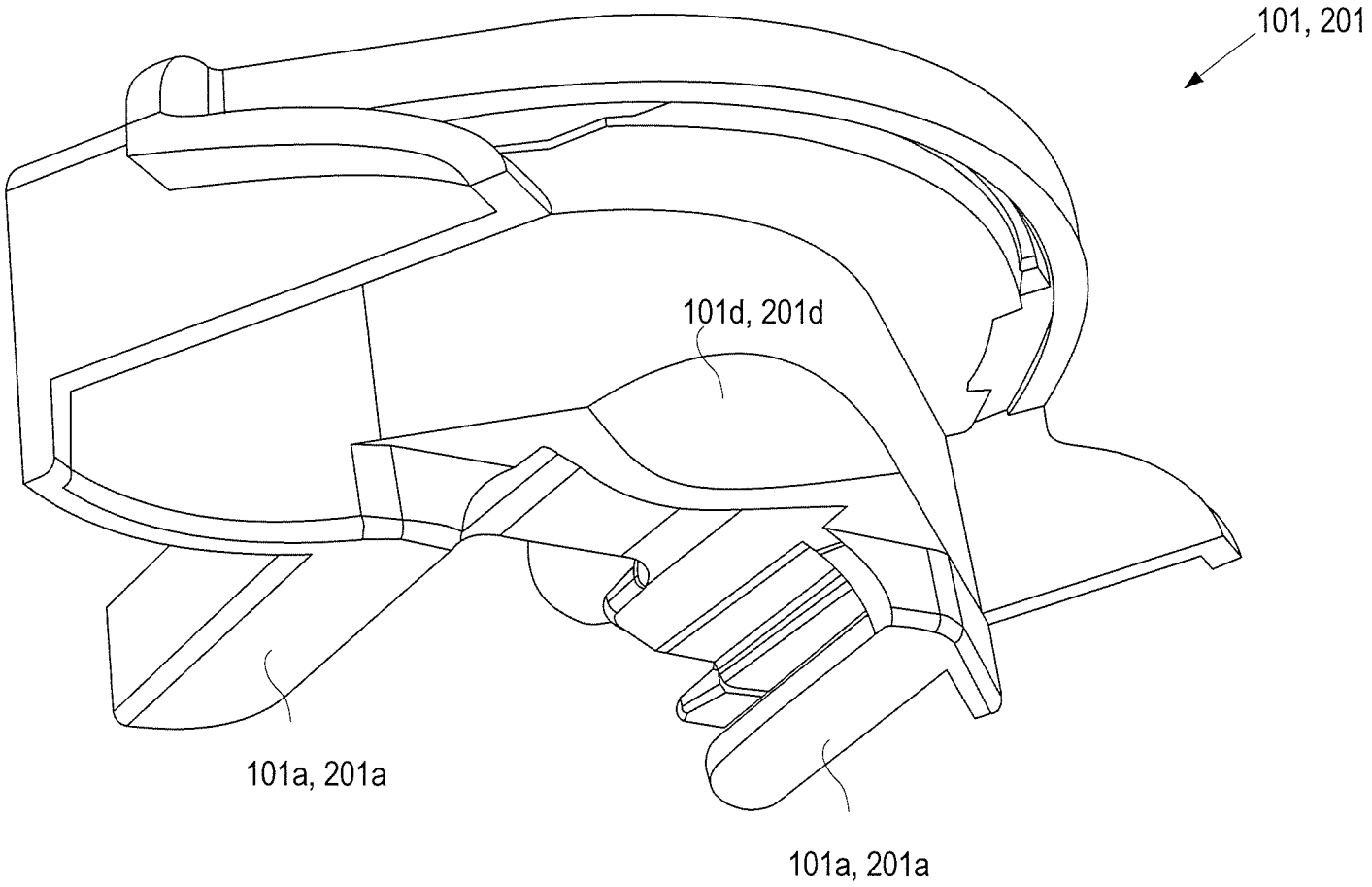
FIG. 4A illustrates a reflector of a first or second configuration of a module assembly according to an exemplary embodiment of the present disclosure.
Figure 4B:
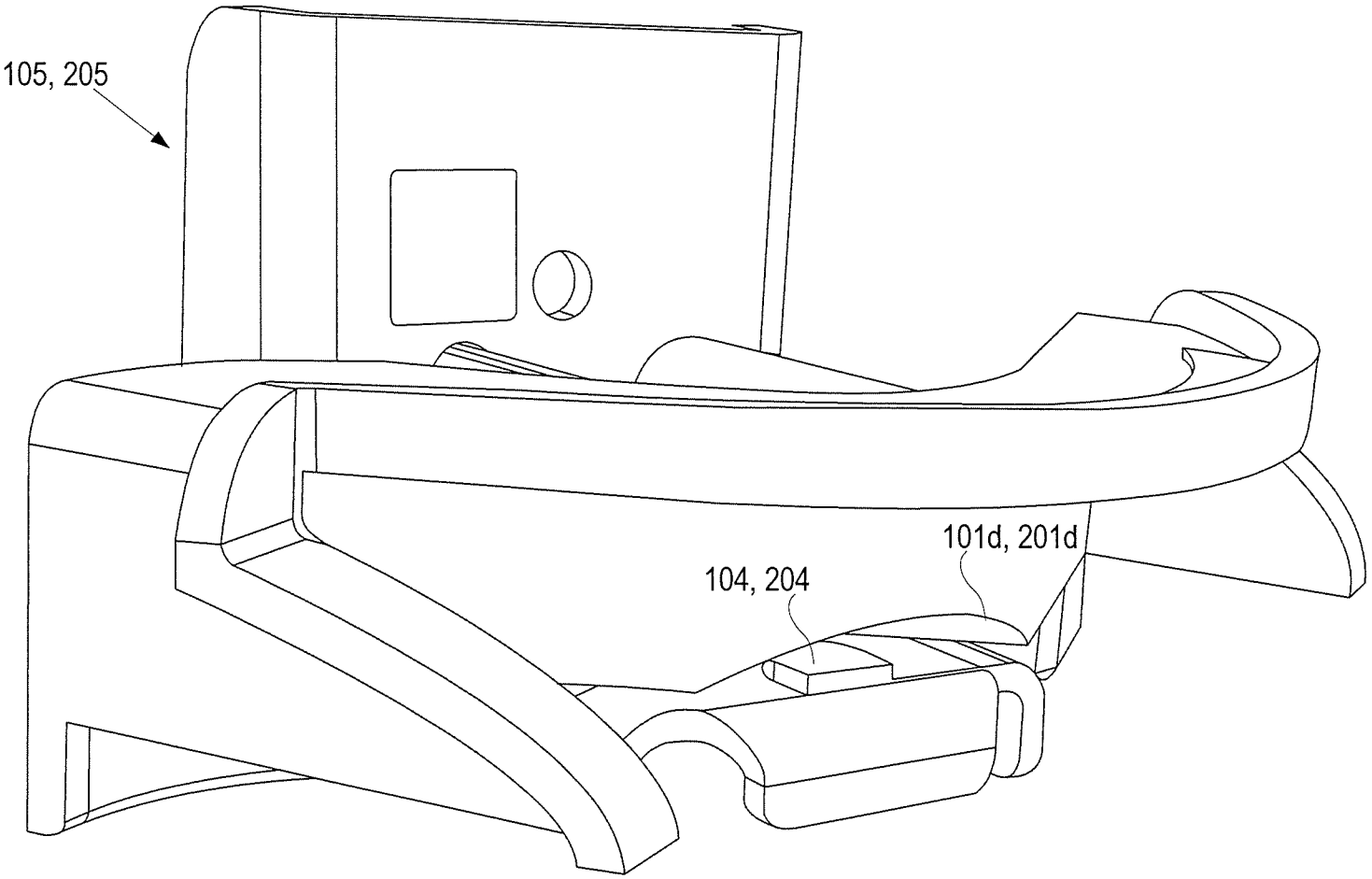
FIG. 4B is an assembly of the reflector and a bracket including a light source according to an exemplary embodiment of the present disclosure.

FIG. 4A is a perspective view of the reflector 101 (or 201) according to an exemplary embodiment of the present disclosure. FIG. 4B is an alternative perspective view of the reflector 101 (or 201) according to an exemplary embodiment of the present disclosure. The reflector 101 (or 201) includes a parabolic reflecting surface 101*d*, 201*d* configured to reflect light from the first light source 104 (or second light source 204) towards the lens 300. The parabolic reflecting surface 101*d*, 201*d* is configured to provide desired light patterns that meet different local requirements. For example, a first light pattern generated by the supplemental light function is illustrated in FIG. 5A, and a second light pattern generated by the static bending light function is illustrated in FIG. 5B.

In addition, parabolic reflecting surface 101*d*, 201*d* can be coated with a metalized layer and/or polished metal, e.g. aluminum, aluminum alloy. The first light source 104 and the second light source 204 can be solid state light sources such as light emitting diodes (LEDs), organic light emitting diodes (OLEDs), polymer light emitting diodes (PLEDs), and/or monolithic LEDs, electrical filament light sources such as halogen light sources and/or incandescent light sources, plasma light sources such as fluorescent lights, and/or any other type of light sources.

Referring back to FIG. 1, the lighting system 2000 includes power source 10, control system 20, switching system 22, and sensor system 24. Power source 10 may include a battery, alternator and/or other device for providing electrical power for electrical and electronic devices of the vehicle 100.

Sensor system 24 includes one or more sensors to detect various conditions within the vehicle or in the vicinity of the vehicle 2000. For example, sensor system may include temperature sensors, photosensors, position sensors, speed sensors, angle sensors, leveling sensors or any other sensor for detecting a diagnostic or other parameter of the vehicle or its ambient environment. Sensors may be passive or "dumb" sensors that provide a voltage representative of the sensed parameter, or so called "smart" sensors with integrated memory and processing capability to analyze the parameter sensed within the sensor itself. In one embodiment, the sensor system 24 includes a steering wheel angle sensor which provides a signal for initiating a lighting function such as a static bending light function as discussed further below Switching system 22 includes electrical switches, mechanical switches, and/or actuators for activating a lighting function of the vehicle. For example, switching system 22 may include transistors as discrete components or within an integrated circuit, which interrupt or pass current to a light source such as a light emitting diodes (LED) in accordance with lighting function requirements. Mechanical switches may be manually operated by a driver or automatically activated by actuators in response to a control signal, for example. A manually operated switch may initiate one or more vehicle lighting or signaling functions. For example, a user manually operating a turn signal switch may initiate a turn signal function as well as a static bending light function. Actuators generally cause movement and may include hydraulic actuators, pneumatic actuators or electrical/electronic actuators such as a stepper motor. Actuators may also be "dumb" devices that react to a simple analog voltage input, or "smart" devices with built-in memory and processing capability.

Switches of the switching system 22 may be activated based on a sensed parameter from sensors of the sensor system 24. Thus, the switching system 22 and sensor system 24 may be connected in a feedback control loop for diagnostic detection and control of the vehicle lighting system 2000 and its lighting devices.

Control system 20 may include any embedded system, processor, electronic control unit ECU or microcontroller, which are typically dedicated to a specific region or function of the vehicle 2000. For example, an ECU may provide memory and control logic functions for several dumb devices, such as passive sensors and switches. Typically, numerous ECUs, with different embedded software, may be found in a single automobile and may communicate via internal vehicle networks such as a Controller Area Network (CAN).

While certain embodiments have been described, these embodiments have been presented by way of example only, and are not intended to limit the scope of the present disclosures. Indeed, the novel apparatuses and systems described herein can be embodied in a variety of other forms; furthermore, various omissions, substitutions and changes in the form of the apparatuses and systems described herein can be made without departing from the spirit of the present disclosures. The accompanying claims and their equivalents are intended to cover such forms or modifications as would fall within the scope and spirit of the present disclosures.

The invention claimed is:

1. A vehicle lighting module system that is configurable comprising:

a shared lens optically configured to provide a first light pattern for a first vehicle lighting function and a second light pattern for a second vehicle lighting function, the shared lens comprising a mounting axis which provides a reference for mounting the shared lens on a vehicle;

first internal optics configured to direct light toward the shared lens to provide the first light pattern for the first vehicle lighting function;

second internal optics configured to direct light toward the shared lens to provide the second light pattern for the second vehicle lighting function; and a coupling system configured to join the shared lens with either the first internal optics to form a first module configuration for providing the first vehicle lighting function, or with the second internal optics to form a second module configuration for providing the second vehicle lighting function, wherein said shared lens conceals physical differences between the first and second internal optics such that the first and second light module configurations have the same appearance when viewed along the mounting axis of the shared lens.

2. The system of claim 1, wherein:

said first light pattern comprises a first direction, a first horizontal spread and a first vertical spread, said second light pattern comprises a second direction, a second horizontal spread and a second vertical spread, and at least one of the first direction, first horizontal spread and first vertical spread of said first light pattern is different from a respective one of the second direction, second horizontal spread and second vertical spread of the second light pattern.

3. The system of claim 2, wherein said shared lens comprises a first region configured to provide said first light pattern, and a second region configured to provide said second light pattern.

4. The system of claim 3, wherein said first region partially overlaps with said second region.

5. The system of claim 2, wherein:

the first internal optics comprise a first reflector configured to direct light for the first light pattern toward the shared lens, and the second internal optics comprises a second reflector configured to direct light for the second light pattern toward the shared lens.

6. The system of claim 3, wherein said shared lens is a blended lens.

7. The system of claim 1, wherein each of the first and second internal optics comprises:

an optical portion including at least one optical element, and a holding portion configured to be attached to the optical portion such that the shared lens is joined with said optical portion to form an integral vehicle lighting module.

8. The system of claim 1, wherein said coupling system comprises a first joining portion provided on said shared lens, and a second joining portion provided on each of the first and second internal optics, the first joining portion configured to engage the second joining portion such that the shared lens can be joined with either one of the first and second internal optics.

9. The system of claim 8, wherein said first joining portion comprises a plurality of tabs provided on said shared lens, and said second joining portion comprises a plurality of corresponding recesses provided on each of said first and second internal optics and configured to engage said respective plurality of tabs.

10. The system of claim 1, further comprising a first light source configured to provide light for the first light pattern and a second light source configured to provide light for the second light pattern.

11. The system of claim 1, further comprising a first bracket configured to fix the first lighting module to a vehicle model, and a second bracket configured to fix the second lighting module to said vehicle model.

12. The system of claim 11, wherein said first and second bracket comprise a shared bracket identically designed for the first and second module configurations.

13. The system of claim 12, wherein said shared bracket comprises a mounting surface for a light source.

14. A lighting module system that is configurable on a vehicle comprising:

a shared lens configured to provide a first light pattern for a first vehicle lighting function and a second light pattern for a second vehicle lighting function, the shared lens comprising a reference through a mounting axis that is configured to mount the shared lens;

a first internal optics that is configured to direct light toward the shared lens to provide the first light pattern of the first vehicle lighting function;

a second internal optics that is configured to direct light toward the shared lens to provide the second light pattern of the second vehicle lighting function; and a coupling system that is configured to join the shared lens with either the first internal optics or the second internal optics to form module configurations that are distinguished and that provide a first or a second vehicle lighting function when viewed along the mounting axis of the shared lens, and wherein a first direction of the first light pattern is offset from a second direction of the second light pattern by an offset angle along a horizon direction substantially perpendicular to said reference axis.

15. A vehicle lighting module system that is configurable comprising:

a shared lens that is optically configured to provide a first light pattern for a first vehicle lighting function and a second light pattern for a second vehicle lighting function, the shared lens comprising a reference by a mounting axis that is configured to mount the shared lens on a vehicle;

a first internal optics configured to direct light toward the shared lens to result in the first light pattern;

a second internal optics configured to direct light toward the shared lens to result in the second light pattern, where the first and second light pattern each represent a first and second vehicle lighting function, respectively; and a coupling system that is configured to join the shared lens with the first internal optics or with the second internal optics to form either a first module configuration or form a second module configuration associated with each respective vehicle lighting function appears the same when viewed along the mounting axis;

a first light source configured to provide light for the first light pattern and a second light source configured to provide light for the second light pattern, where the first light source and said second light source is positioned offset from one another by an X offset distance to the reference axis and by a Y offset distance that is perpendicular to said X direction.

16. The system of claim 15, wherein said X offset amount is approximately 2 mm and said Y offset amount is approximately 6.38 mm.

17. The system of claim 16, wherein the first lighting function is a supplemental lighting function for enhancing a high beam light function; and the second lighting function is a static bending lighting function for illuminating a turning path of the vehicle.

18. The system of claim 17, wherein:

the supplemental lighting function provides a light beam substantially along said reference axis of the shared lens; and the static bending lighting function provides a light beam along a direction which is offset from said reference axis by a predetermined angle.

19. The system according to claim 18, wherein the predetermined offset angle is greater than 0 degrees and less than 90 degrees.

20. The system according to claim 19, wherein said predetermined offset angle is approximately 30 degree.

* * * * *